US005558825A

United States Patent [19]

Ueda et al.

[11] Patent Number: 5,558,825

[45] Date of Patent: Sep. 24, 1996

[54] METHOD AND APPARATUS FOR PRODUCING POLYESTER FIBER

[75] Inventors: Kunihiko Ueda, Otsu; Shuko Arakane, Okazaki; Takao Sano, Moriyama; Yuhei Maeda, Mishima, all of Japan

[73] Assignee: Toray Industries, Inc., Tokyo, Japan

[21] Appl. No.: 256,144

[22] PCT Filed: Nov. 10, 1993

[86] PCT No.: PCT/JP93/01632

§ 371 Date: Sep. 9, 1994

§ 102(e) Date: Sep. 9, 1994

[87] PCT Pub. No.: WO94/11550

PCT Pub. Date: May 26, 1994

[30] Foreign Application Priority Data

Nov. 10, 1992 [JP] Japan ..... 4-300120

[51] Int. Cl.[6] ..... D01D 5/088; D01D 5/16; D01D 10/02; D02J 1/08

[52] U.S. Cl. ..... 264/103; 28/245; 28/246; 28/271; 57/289; 57/350; 57/908; 264/130; 264/210.5; 264/210.8; 264/211.12; 264/211.15; 264/211.17; 264/235.6; 425/66; 425/72.2; 425/106; 425/378.2; 425/379.1; 425/382.2

[58] Field of Search ..... 264/103, 130, 264/210.5, 210.8, 211.12, 211.14, 211.15, 211.17, 235.6, 290.5, 290.7, 346, DIG. 28; 425/66, 72.2, 106, 378.2, 379.1, 382.2, 445, DIG. 17; 28/245, 246, 271; 57/289, 350, 908

[56] References Cited

U.S. PATENT DOCUMENTS

| | | | |
|---|---|---|---|
| 4,070,432 | 1/1978 | Tamaddon | 264/210.5 X |
| 4,456,575 | 6/1984 | Smith et al. | 264/211.17 |
| 5,066,439 | 11/1991 | Nishikawa et al. | 264/103 |
| 5,087,401 | 2/1992 | Yokoyama et al. | 264/130 |

FOREIGN PATENT DOCUMENTS

| | | | |
|---|---|---|---|
| 54-18918 | 2/1979 | Japan . | |
| 56-5841 | 2/1981 | Japan . | |
| 3-180537 | 8/1981 | Japan . | |
| 59-53716 | 3/1984 | Japan . | |
| 61-194210 | 8/1986 | Japan | 264/211.15 |
| 62-90311 | 4/1987 | Japan | 264/211.17 |
| 62-141118 | 6/1987 | Japan . | |
| 62-162014 | 7/1987 | Japan | 264/211.15 |
| 62-162015 | 7/1987 | Japan | 264/211.17 |
| 2-4693 | 1/1990 | Japan . | |
| 4-28806 | 5/1992 | Japan . | |

*Primary Examiner*—Leo B. Tentoni

*Attorney, Agent, or Firm*—Nikaido, Marmelstein, Murray & Oram LLP

[57] ABSTRACT

This invention relates to a method and apparatus for producing a polyester fiber which cools a plurality of molten polyester fibers from a spinnert 2 to a temperature below a glass transition point, then takes up the fibers by a non-heating first godet roller at a take-up speed less than 4,000 m/min, heat-stretching the fibers between the first godet roller and a non-heating second godet roller 10 inside a normal pressure steam atmosphere (first heat-treating device 8) higher than the glass transition point of the polyester fiber, and heat-treats the fiber by a pressurized steam atmosphere (second heat-treating device 9) higher than 105° C.

24 Claims, 3 Drawing Sheets

METHOD AND APPARATUS FOR PRODUCING POLYESTER FIBER

TECHNICAL FIELD

This invention relates to a method and apparatus for producing a polyester fiber. More specifically, the present invention relates to a method and apparatus for producing a polyester fiber having mechanical and thermal characteristics suitable for the application of woven fabrics and knitted fabrics and having particularly excellent dyeing characteristics.

BACKGROUND ART

As one of the methods of producing a polyester fiber having strength and elongation characteristics suitable for woven fabrics and knitted fabrics at a low cost of production, a so-called "direct spin draw system" has been proposed as described, for example, in Japanese Patent Application Kokai Publication No. 54-18918. According to this system, melt-and-spun polyester fibers are wound a plurality of times on a pair of heated godet rollers (hereinafter referred to as the "heating godet rollers") and on separate rollers to raise the fiber temperature, are again wound on another pair of heating godet rollers rotating at a higher speed and separate rollers, a plurality of times, respectively, and are stretched between both groups of rollers.

According to this production method, however, the fibers must be wound a large number of times on the heating godet rollers through the separate rollers so as to sufficiently heat the fibers. Therefore, when the number of spun yarns is increased to improve productivity, adjacent yarns are likely to overlap with one another to cause yarn breakage, the equipment becomes large in scale and power consumption of the heating rollers becomes greater.

To solve these problems, Japanese Patent Application Kokai Publication No. 62-141118 proposes a method which takes up the melt-and-spun yarns on non-heating rollers rotating at a speed of higher than 4,000 m/min, then draws the yarns while jetting a heating steam to the yarns to heat them to a temperature higher than their glass transition point. Though this production method provides the advantage that the separate rollers become unnecessary, it is not free from the following problems because the method is fundamentally based on the premise of high speed take-up at higher than 4,000 m/min. Namely, when the melt-and-spun yarns travel between a spinneret and a high speed take-up roller, a structure rich of a crystalline phase is formed due to cooling of the yarns by air and to a drawing operation, and even when drawing and heat-treatment (heat-set) are thereafter applied so as to obtain a predetermined elongation, the degree of orientation (birefringence) of the fibers finally obtained is low, so that the application of the fiber is remarkably limited.

When the take-up speed is lowered below 4,000 m/min in this method to obtain a fiber having a high degree of orientation (birefringence), it has been found out that dyeing specks occur during a dyeing step and the resulting fiber cannot be used for practical applications.

DISCLOSURE OF THE INVENTION

It is an object of the present invention to provide a method and apparatus for producing a polyester fiber which can produce a polyester fiber having excellent mechanical characteristics such as high strength and elongation suitable for woven fabrics and knitted fabrics and thermal characteristics such as boiling shrinkage and drying shrinkage, and particularly excellent dyeing characteristics, while increasing the number of spun yarns for improving productivity, without using the heating rollers and the separate rollers.

To accomplish the object described above, a method of producing a polyester fiber according to the present invention comprises cooling a plurality of melt-and-spun polyester fibers from a spinneret to a temperature below the glass transition point of the polyester fiber, taking up the fibers by a first non-heating godet roller at a take-up speed less than 4,000 m/min, heat-drawing the polyester fibers between the first non-heating godet roller and a second non-heating godet roller in a normal pressure steam atmosphere the temperature of which is higher than the glass transition point of the polyester fiber, and heat-treating the fibers in a pressurized steam atmosphere higher than 105° C.

An apparatus for producing a polyester fiber according to the present invention comprises a melt-spinning portion for spinning a plurality of fibers from a spinneret, a chimney for cooling the fibers spun from the melt-spinning portion to a temperature below a glass transition point, a first non-heating godet roller for taking up the fibers cooled by the cooling chimney at a take-up speed less than 4,000 m/min, a second non-heating godet roller for drawing the fibers, rotating at a peripheral speed higher than that of the first godet roller, a first heat-treating device for heating the fibers between the first and second godet rollers to a temperature higher than the glass transition point in a normal pressure steam atmosphere, and a second heat-treating device for heat-treating the fibers to a temperature above 105° C. in a pressurized steam atmosphere, disposed downstream of the first heat-treating device.

The inventors of the present invention have examined in detail the condition of dyeing specks occurring when the take-up speed is lowered below 4,000 m/min in the method of the afore-mentioned Japanese Patent Application Kokai Publication No. 62-141118, and have found out that the major proportion of the dyeing specks consist of so-called "dyeing flecks" or in other words, the condition where undrawn yarn portions are finely distributed in the longitudinal direction of the drawn yarns.

The present invention sets the steam atmosphere at the drawing portion to the normal pressure steam atmosphere in which the temperature is higher than the glass transition point and the pressure is substantially equal to the atmospheric pressure, and makes it possible to mildly heat the yarns. In this way, the present invention uniformly brings the form of the fibers immediately before the exposure to the steam into a state where the single yarns are aligned uniformly, and can thus solve the problem described above.

The present inventors have furthered the study in detail about the mechanism of the occurrence of the dyeing specks and have found that the dyeing flecks occur primarily because the undrawn yarns obtained at a take-up speed of less than 4,000 m/min are abruptly exposed to the high temperature super-heated steam. In other words, the yield point stress of the undrawn yarns lowers with the temperature rise and the yarns can be easily drawn even under a low tension. Accordingly, when the yarns are exposed to the super-heated steam and are abruptly heated, alignment of the single yarns becomes non-uniform in the longitudinal direction because the tension is low, and entanglement and crossing of the single yarns occur in consequence. The mode of the heat input to the single yarns differs between the single yarns positioned at an outside portion and the single yarns positioned at an inside portion, and the amount of application of an oiling agent differs between the single yarns, too. In such cases, the mode of the temperature rise differs, and non-uniformity of alignment of drawing occurs between the single yarns in the longitudinal direction, and the portions which are not sufficiently drawn occur and thus result in the dyeing flecks.

Accordingly, when the melt-and-spun yarns are taken up at a relatively low take-up speed of less than 4,000 m/min using the non-heating first and second godet rollers but not using the heating rollers and the separate rollers in the present invention, the fibers having properties analogous to those of the conventional direct spun-drawn yarns and not causing the dyeing specks can be produced by drawing the yarns in the normal pressure steam atmosphere and carrying out heat-treatment in the pressurized steam atmosphere.

In the present invention, the term "polyester fiber" primarily means a polyester comprising at least 90 mol % of ethylene terephthalate, but up to 10 mol % of other components, i.e. monomers of isophthalic acid, phthalic acid, oxy-benzoic acid, a sulfonate compound, polyethylene glycol, tetramethylene glycol, etc, or other copolymerized or blended polymers. Further, small amounts of a delustering agent, a charge controller, a dyeing property improving agent, and so forth, may be blended.

BEST MODE FOR CARRYING OUT THE INVENTION

Hereinafter, some preferred embodiments of the present invention will be described in detail with reference to the accompanying drawings.

Figure 1:
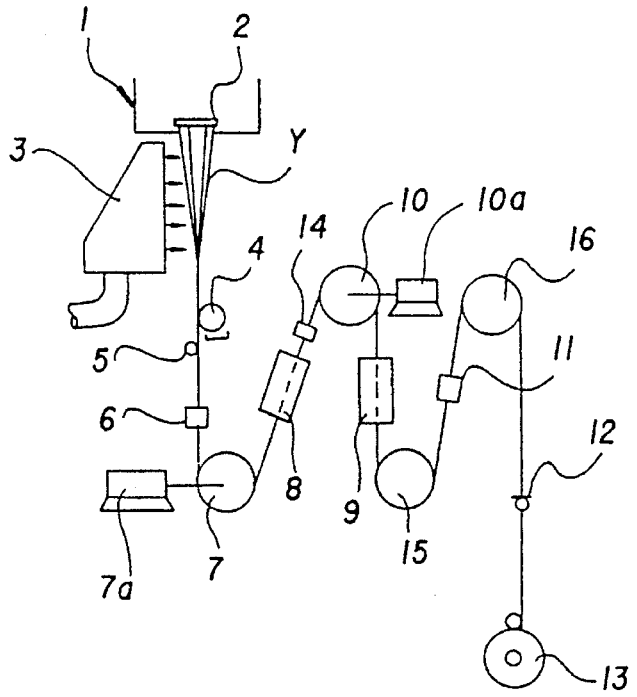
FIG. 1 is a schematic view showing an apparatus for practicing a production method of a polyester fiber according to an embodiment of the present invention.

FIG. 1 schematically shows an apparatus for practicing the method of the present invention. In the drawing, reference numeral 1 denotes a melt/spinning portion, and a spinneret 2 having a plurality of orifices for melt-spinning a polyester fiber (hereinafter merely called the "fiber") Y is fitted to the bottom portion of the melt/spinning portion 1. A cooling chimney 3 for cooling a plurality of fibers spun from the spinneret 2 to a temperature below a glass transition point of the fiber is disposed below the spinneret 2, and an oiling device 4 and a collector guide 5 are also disposed below the chimney 3.

Reference numeral 7 denotes a first godet roller for taking up the fiber spun from the spinneret 2. This roller 7 is directly connected to known speed change means 7*a* such as a motor equipped with a transmission, an inverter motor, etc, so that its peripheral speed can be independently controlled by an instruction from a controller. The speed change means 7*a* changes the peripheral speed of the first godet roller 7 within a range of about 2,000 to 4,000 m/min. Reference numeral 10 denotes a second godet roller which rotates at a higher peripheral speed than the peripheral speed of the first godet roller 7 and imparts a predetermined draw ratio to the fiber between the first and second godet rollers 7, 10. The second godet roller 10 is directly connected to speed change means 10*a* having a similar construction to that of the speed change means 7*a*, and its peripheral speed can be changed within a range of about 4,000 to about 7,000 m/min by an instruction from the controller. Both of the rollers 7 and 10 are non-heating rollers not equipped with heating means.

Third and fourth godet rollers 15 and 16 are disposed downstream of the second godet rollers 10*a* and finally, a take-up machine 13 is provided. The third and fourth godet rollers 15, 16 and the take-up machine 13 are so set as to have a peripheral speed of 4,000 to 7,000 m/min which is substantially equal to the peripheral speed of the second godet roller 10. A first heat-treating device 8 is disposed in a drawing zone between the first and second godet rollers 7 and 10 and a second heat-treating device 9 is disposed between the second and third godet rollers 10 and 15. Twisting nozzles 11, 14 and a collector guide 12 by pressurized air are disposed in a zone ranging from the first heat-treating device 8 to the take-up machine 13, whenever necessary.

Figure 2:
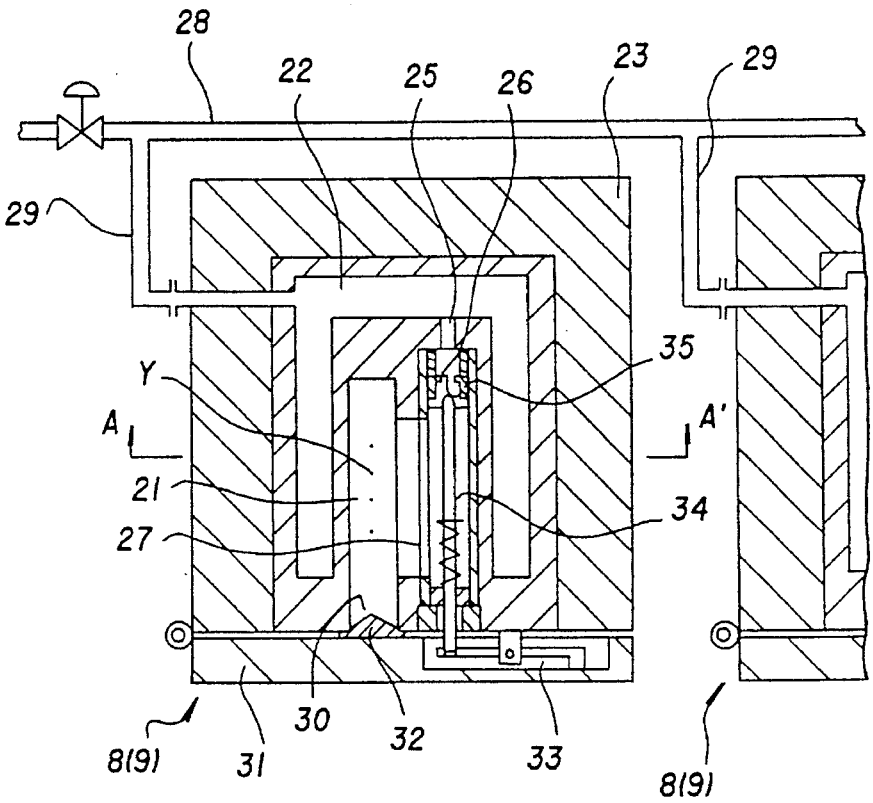
FIG. 2 is a transverse sectional view of a normal pressure steam treating apparatus or a pressurized steam treating apparatus in the apparatus shown in FIG. 1.
Figure 3:
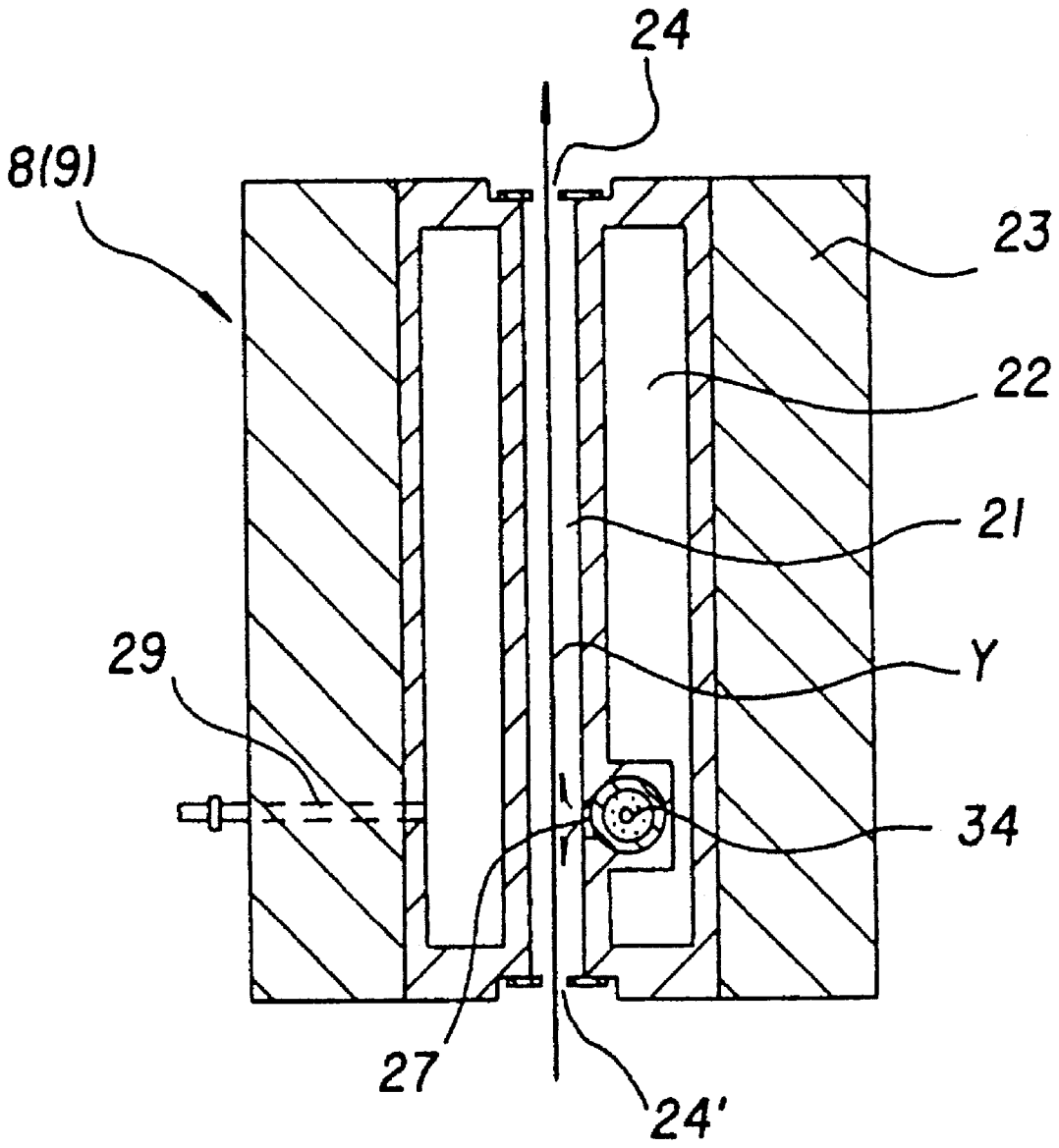
FIG. 3 is a sectional view taken along a line A–A' of FIG. 2.

The first and second heat-treating devices 8, 9 have the construction shown in FIGS. 2 and 3, for example. The first heat-treating device functions as a normal pressure steam treating device for heating the polyester fiber to a temperature above 80° C., the glass transition point of the polyester fiber, by jetting a normal pressure steam, and effects its control so that the fiber immediately after being taken up to by first godet roller 7 is not drastically drawn due to a drastic temperature rise. Though the temperature of this normal pressure steam must be above the glass transition point of the polyester fiber, it is below 250° C. and preferably below 150° C. so as to prevent a rapid temperature rise of the fiber and thus to prevent dyeing speck. A suitable value of the length of a heat-treating chamber 21 along the yarn Y varies with the size of the object yarn and its speed, but it is preferably at least 50 mm in order to supply minimum necessary heat to the fiber and is preferably not greater than 500 mm and more preferably, not greater than 150 mm, in order to allow the yarn to rapidly pass through the first heat-treating chamber after drawing so as to restrict dyeing speck.

On the other hand, the second heat-treating device 9 functions as a pressurized steam treating device for jetting a pressurized steam of not lower than 105° C. so that the fiber has a practical level of heat shrinkage characteristics by sufficient heat-treatment. The length of the heat-treating chamber 21 along the yarn Y is preferably at least 100 mm so as to carry out minimum necessary heat-treatment. However, if this value is too great, the effect of the heat-treatment becomes excessively high, so that it becomes difficult to obtain a fiber having a high heat shrinkage ratio cannot be obtained easily and equipment becomes great in scale. Therefore, the length is preferably up to 1,000 mm.

As shown in FIGS. 2 and 3, the heat-treating device 8 (9) includes a plurality of spindles juxtaposed with one another and the thinly elongated heat-treating chamber 21 having a flat sectional shape. Further, the outside of this chamber 21 is encompassed by a heat-retaining jacket 22 and the outer periphery of the jacket 22 is covered with a heat-insulating material 23. Yarn passage ports 24, 24' having a contracted area and a slit-like shape are disposed at both end portions of the heat-treating chamber 21 so that a plurality of fibers can be uniformly drawn, and the fibers Y are allowed to travel inside the heat-treating chamber 21 through these yarn passage ports 24, 24'.

A metering orifice 26 is disposed between the heat-retaining jacket 22 and the heat-treating chamber 21 through a flow path 25 on the side of the heat-retaining jacket 22, and communicates with the heat-treating chamber 21 through a slit-like nozzle 27. Accordingly, the steam supplied to the heat-retaining jacket 22 of each heat-treating device 8 (9) from a steam feed pipe 28 through a distribution pipe 29 is controlled by the metering orifice 26 to a predetermined pressure and to a predetermined flow rate, then inflows to the heat-treating chamber 21 through the nozzle 27 and heat-treats the fibers Y.

In the heat-treating device 8 (9) described above, the side portion of the heat-treating chamber 21 opens in the travelling direction of the fiber Y, and a packing 32 disposed inside a door 31 opens and closes this opening 30, so as to facilitate a threading operation. A rod 34 is engaged with the door 31 in the interlocking arrangement through an arm 33. When the door 31 is opened, a valve 35 at the distal end of the rod 34 closes the metering orifice 26 and the steam on the side of the heat-retaining jacket 22 is prevented from leaking to the heat-treating chamber 21.

Figure 4:
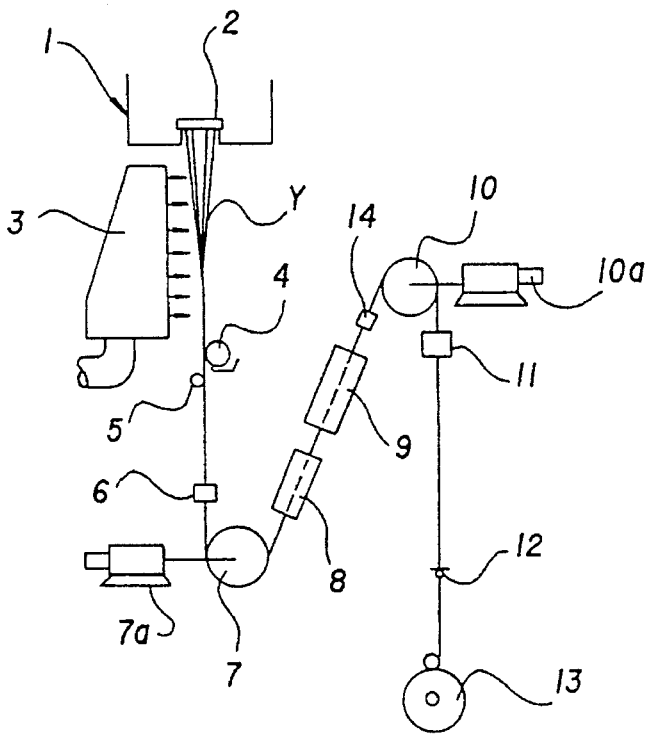
FIG. 4 is a schematic view showing an apparatus for practicing the method according to another embodiment of the present invention.
Figure 5:
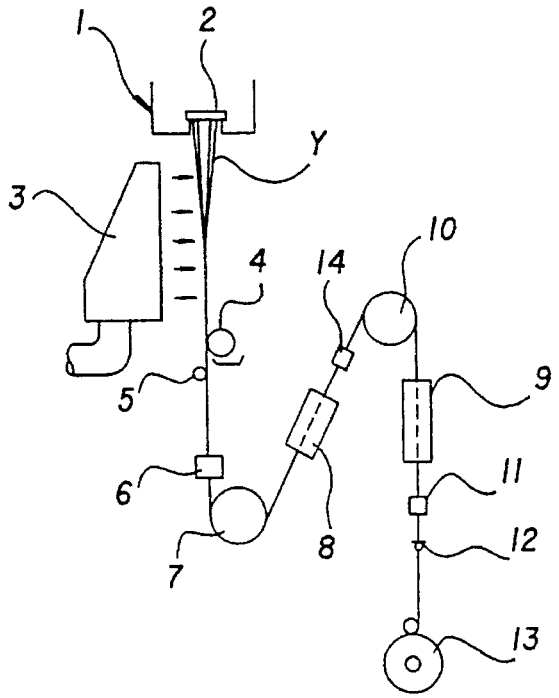
FIG. 5 is a schematic view showing an apparatus for practicing the method according to still another embodiment of the present invention.

In the apparatus for practicing the present invention described above, the third and fourth godet rollers 15, 16 are not always necessary, and can be omitted as in the apparatus shown in FIGS. 4 and 5. In this case, the second heat-treating device 9 may be disposed on either the upstream side or the downstream side of the second godet roller 10 as shown in FIGS. 4 or 5.

To conduct heat-treatment in the second pressurized steam treating device 9, the fiber is preferably exposed to the heating atmosphere at a tension as low as possible. Therefore, in the construction shown in FIG. 4 wherein the pressurized steam treating device 9 is disposed downstream of the normal pressure steam treating device 8 between the first and second godet rollers 7 and 10 as shown in FIG. 4, heat-treatment is carried out at a high tension after drawing. Therefore, this construction involves the restriction to cope with a variety of kinds of products. To cope with a variety of products, therefore, the pressurized steam treating device 9 is disposed preferably downstream of the second godet roller 10 as shown in FIG. 5 because the tension for heat-treatment can be selected independently of the tension for drawing. More preferably, the third and fourth godet rollers 15, 16 are disposed as in the apparatus shown in FIG. 1 so that the tension in the pressurized steam treating device 9 is not affected by the take-up tension by the take-up machine 13. In this way, freedom of the process can be drastically improved.

In the production method of the polyester fiber according to the present invention, it is important that the take-up speed of the fiber at the first godet roller 7 be less than 4,000 m/min. If the take-up speed at the first godet roller 7 is higher than 4,000 m/min, the fiber Y spun from the spinneret 2 receives the remarkable cooling and drawing effects between the spinneret and the godet roller due to the air resistance and the cooling effect between the spinneret and the first godet roller, and a fiber structure having a greater proportion of the crystalline phase is formed. Even when an attempt is made to stretch such a fiber and to obtain the intended fiber having a low elongation, the stretch ratio is limited and the degree of orientation (birefringence) of the fiber finally obtained becomes low because the fiber is in advance drawn between the spinneret and the first godet roller. Obviously, the application of such a fiber is limited.

On the other hand, the lower limit of the take-up speed of the first godet roller 7 is naturally determined by making backward calculation from the draw ratio required for obtaining the yarn having the target properties with respect to the speed of the second godet roller 10 determining the production speed. Preferably, the target is set to fibers having an elongation of about 30% as a scale for most of the applications. However, if super-draw occurs during the passage of the fiber through the normal pressure steam atmosphere, dyeing speck becomes vigorous. For this reason, the lower limit is preferably set to 2,000 m/min. Since the first godet roller is the non-heating roller, the fiber passing through this roller is not heated.

After leaving the first godet roller, the yarn Y is drawn to a draw ratio of 1.2 to 2.5 times by the first and second godet rollers 7, 10 while being heated to a temperature above the glass transition point inside the normal pressure heating device 8. After leaving the normal pressure steam treating device 8, the fiber then enters the pressurized steam treating device 9, where it is heated and treated to a temperature above 105° C. by the pressurized steam.

The fiber taken up at a rate less than 4,000 m/min at the first godet roller is a so-called "undrawn yarn" in which orientation has not yet developed sufficiently. Therefore, when this yarn is heated and drawn by a super-heated steam, so-called "die fleck", or in other words, the scattering of fine undrawn yarn portions in the longitudinal direction of drawn yarn occurs. Studies carried out by the present inventors have clarified that the cause for the occurrence of this die fleck lies in that the undrawn yarn taken up at a take-up speed of less than 4,000 m/min is suddenly exposed to a super-heated steam having a high temperature. In other words, the yield stress of the undrawn yarn drops with the temperature rise and the yarn can be drawn easily even at a low tension. Accordingly, when the undrawn yarn is exposed to the super-heated steam having a high temperature, the temperature of the yarn quickly rises and the elongation start point occurs. However, since the tension is low, alignment of the individual single yarns becomes non-uniform in the longitudinal direction, and crossing and entanglement of these yarns come to exist. If the mode of receiving heat is different between the single yarns positioned outside and those positioned inside or if the amount of application of an oiling agent is different between the individual single yarns, the mode of the temperature rise of these yarns is mutually different and for this reason, the portions of the yarns which are not sufficiently stretched are left, thereby inviting the die fleck.

To cope with the problem described above, the first heat-treatment step in the drawing processing in the present invention treats the polyester fiber with the normal pressure steam having a temperature above the glass transition point of the fiber using a normal pressure steam treating device so as to prevent the drastic temperature rise of the yarns. Next, the as-drawn fiber is not yet free from the problems such as insufficient heat-treatment, a large thermal shrinkage and low applicability to the practical use. Accordingly, heat-treatment is carried out again by the pressurized steam treating device having higher heat-treatment efficiency.

This second heat-treatment step must be able to impart sufficient heat so as to eliminate an internal strain which has become latent at the point of drawing of the fiber. Therefore, though a super-heated steam having a high temperature may be usable, it has lower heat-treatment efficiency than the pressurized steam, and the temperature must be elevated. Moreover, it is difficult to obtain a steam having a predetermined temperature because heat diffusion is likely to occur. For these reasons, the use of the pressurized steam is most suitable.

The temperature of such a pressurized steam can be determined in accordance with heat shrinkage characteristics of the intended fiber, and is preferably set to 105° to 158° C. (0.5 to 5.0 kg/cm$^2$.G in terms of a saturation pressure). If the temperature is lower than 105° C., heat shrinkage characteristics become so great and drastically change with even a slight change of the temperature (pressure), that a uniform fiber cannot be obtained easily. As to the upper limit temperature, on the other hand, the higher the temperature and pressure of the atmosphere inside the pressurized steam treating device, the greater becomes an energy loss. Accordingly, it is preferred to set it to a saturation pressure of 5 kg/cm$^2$.G, that is, to about 158° C., which can be provided generally by a readily obtainable heat source.

In the method of the present invention, the fiber tension between the first godet roller and the normal pressure steam treating device, that is, the fiber tension T immediately before the first heat-treating device, is more preferably set so as to satisfy the following relational formula:

$$0.5\sigma \leqq T < \sigma$$

where $\sigma$ is a yield stress (g/Denier) of the polyester fiber immediately before the first heat-treatment step.

It is assumed that the fiber is heated by the normal pressure steam treating device and drawing starts occurring at the point of time when the tension exceeds the yield stress at that fiber temperature. However, when the tension between the first godet roller and the normal pressure steam treating device is lower than ½ of the yield stress of the undrawn yarn at the room temperature (i.e. $0.5\sigma$), entanglement between the single yarns cannot be prevented, and the start of drawing becomes non-uniform because the mode of acceptance of heat and the action of the tension are microscopically different between the individual single yarns. Accordingly, drawing becomes non-uniform and dyeing speck is likely to occur. On the contrary, when the fiber is kept beforehand at a tension higher than the yield stress at the room temperature and a phenomenon analogous to preliminary drawing occurs before the fiber enters the normal pressure steam treating device, so-called "cold drawing" occurs, so that a fiber having excellent properties cannot be obtained.

To obtain a desired tension, the fiber must not be heated too drastically by the normal pressure steam treating device as already described, and tension can be regulated by a draw ratio, too.

In other words, when the draw ratio of the fiber is increased, the fiber tension increases between the first godet roller and the normal pressure steam treating device. Quite naturally, however, the higher the draw ratio, the smaller becomes the residual elongation of the fiber. Therefore, the speeds of the first and second godet rollers must be set so as to attain a desired draw ratio in accordance with the target degree of draw. The yarn is drawn when the yarn temperature becomes higher than the glass transition point in the normal pressure steam atmosphere. However, the draw positions vary between the individual single yarns due to various factors such as variance in the application amount of the oiling agent, variance in the temperature due to the positions of the yarns, variance of the draw stress, entanglement of the yarns, and so forth. The dyeing fleck occurs when these variances become large, prevent this problem, a preferred method is to first cool a plurality of polyester fibers to a temperature below the glass transition point and then to prevent the application of the entanglement until the fibers pass through the normal pressure steam atmosphere. By so doing, the difference of the draw stresses between the yarns due to the entanglement, etc, becomes small and uniform drawing not generating the dyeing fleck becomes possible. The second preferred method to prevent the dyeing fleck imparts the oiling agent by a roller oiling device. A method using a guide oiling device is generally known as the method of applying the oiling agent, but this method is more likely to generate variance of the application amount of the oiling agent between the yarns than the roller oiling device and to collect more completely the yarns, so that the temperature difference becomes greater between the inner and outer layers of the fibers in the normal pressure steam atmosphere and uniform drawing is inhibited. The application amount of the oiling agent may be an ordinary amount but is preferably up to 1% on the basis of the fiber weight and the concentration of the oiling agent is preferably up to 15%.

In the first heat-treating device, on the other hand, a friction member is preferably disposed at the yarn passage port of, or inside, the first heat-drawing device so as to restrict the draw positions of the yarns by the difference of tensions before and after the passage of the yarns through this friction member and to thus align the draw position of each yarn to a predetermined position. The friction member is preferably rod-like or flat sheet-like in order to simultaneously process a plurality of yarns, and is preferably made of ceramics to secure durability. A gas stream flowing with the fiber exerts adverse influences on variations in the temperature rise of the yarns inside the first drawing device. Therefore, the yarn passage port is preferably slit-like having a width of up to 1 mm. Further, to limit variations in the yarn temperatures in their longitudinal direction and between a plurality of yarns, a nozzle portion of the first heat-treating device forms the slit. In this case, the longitudinal direction of the slit is preferably vertical to the traveling direction of the fiber, and it is more preferred that this slit forms a pair of slits opposing each other, and means for elevating back pressure such as a metal net, a non-woven fabric, a sintered body, etc, are disposed at the nozzle portion of the first heat-treating device, or a rectification member such as a honeycomb is disposed at the nozzle portion.

On the other hand, a suitable value exists for the tension acting on the fiber in the pressurized steam treating device. To conduct heat-treatment, the fiber is preferably exposed to the heating atmosphere at a tension as low as possible. Therefore, in the case of the construction shown in FIG. 4 wherein the pressurized steam treating device is disposed between the first godet roller and the second godet roller in succession to the normal pressure steam treating device for drawing, heat-treatment is carried out at a high tension after drawing. Accordingly, this construction involves the limitation from the aspect of coping with a broad range of kinds of products. To solve this problem, the construction wherein the pressurized steam treating device is disposed downstream of the second godet roller and the heat-treatment is carried out between the take-up machine 3 and the second godet roller 10 as shown in FIG. 5 is much more preferred. It is also further preferred to dispose the third, and fourth godet rollers 15, 16 between the pressurized steam treating device 9 and the take-up machine 13 as shown in FIG. 1. To optimize the tension acting on the fiber in the pressurized steam treating device in this case, it is preferred to apply a stretch ratio of at least 0% to 10% to the fiber in the pressurized steam treating device between the second and third godet rollers. If the stretch ratio is under 0% or in other words, in the case of the relax treatment, adhesion to the second godet roller is likely to occur, and when the stretch ratio exceeds 10%, distortion at the time of the heat-treatment remains in the fiber even after take-up and the take-up operation becomes more difficult.

In the present invention, entanglement can be imparted at an arbitrary position to a plurality of polyester fibers after they are cooled to a temperature below their glass transition point, but is preferably imparted by the interlacing nozzle 6 and/or the interlacing nozzle 14 upstream of the second godet roller in order to prevent backward winding of individual single yarns constituting the fibers to the second godet roller or to prevent the problem that when a part of the single yarns constituting the filament loses sufficient grip force on the second godet roller and undergoes slipping and when the fibers taken up are beaten, the fiber has crimps, or to prevent variance of the properties such as a shrinkage ratio between the single yearns. The degree of entanglement in this case is at least 1/meter and preferably, up to 5 per meter. If the degree of entanglement is less than 1/meter, backward winding to the second godet roller or slip on the second godet roller described above occurs, and if it exceeds 5/meter, uniform drawing on the normal steam treating device would be hindered due to the vibration at the time of application of entanglement or to entanglement of the single yarns, so that dyeing flecks is likely to occur.

To prevent the occurrence of the dyeing flecks, it is preferred to employ a method which cools the melt-spun fiber to a temperature below the glass transition point, does not impart entanglement until the fiber passes through the normal pressure steam atmosphere, and imparts the entanglement at the position of the interlacing nozzle 14 upstream of the second godet roller after the fiber has passed through the normal pressure steam atmosphere. In the case of the arrangement shown in FIG. 4, the interlacing nozzle may be disposed between the normal pressure treating device 8 and the pressurized steam treating device 9.

When the entanglement is imparted after the fiber passes through the normal pressure steam atmosphere, and upstream of the second godet roller, a difference of the stretch tension occurs between the single yarns if a high degree of entanglement is imparted, so that dyeing flecks are likely to occur in some cases. Accordingly, the degree of entanglement is preferably up to 5 per meter on the second godet roller. This degree of entanglement correspond to not more than 3 $kg/cm^2 \cdot G$ in terms of the feed pressure when calculated into the pressurized air pressure of the interlacing nozzle, through the value varies with the drawing condition and the kind of the interlacing nozzles.

Incidentally, the tension between the first godet roller 7 and the second godet roller 10 becomes high due to drawing. Accordingly, a high degree of entanglement cannot be expected even when the interlacing nozzle 14 is inserted. For this reason, the degree of entanglement is preferably compensated for by inserting the interlacing nozzle 11 immediately downstream of the second godet roller 10. However, when the interlacing nozzle 11 is installed in the zone where the fiber is taken up by the take-up machine 13 in the case of the apparatus shown in FIGS. 4 and 5, it becomes sometimes difficult to attain stably a suitable take-up tension by the increase of the tension by the interlacing nozzle 11. FIG. 1 shows a counter-measure in this case. The third and fourth godet rollers 15, 16 are disposed between the second godet roller 10 and the take-up machine 13, and after heat-treatment is conducted between the second godet roller 10 and the third godet roller 15 by the pressurized steam treating device 9, the interlacing nozzle 11 is disposed between the third and fourth godet roller 16 so as to set the tension suitable for imparting the entanglement. According to this construction, the tension can be set in accordance with the intended object independently of the take-up tension, and freedom of the intended fiber products can be improved. In this case, a high entanglement yarn can be obtained by setting the peripheral speed of the fourth godet roller to the equal peripheral speed to that of the third godet roller, or to a value within up to 2% of the latter.

Any oiling device can be used as the oiling device 4 so long as it can uniformly supply the oil, but generally, uniform oiling can be made between the single yarns by the use of an oiling roll, and heat-set of the drawn yarns can be made uniform.

The surface of the first and second godet rollers is preferably a mirror surface in order to tightly clamp and take up the fiber. If the surface is not the mirror surface and has insufficient clamp force, a part or the whole of the single yarns constituting the filament undergo slipping on the first or second godet roller. To improve the clamp force in this case, the effective contact length of each of the rollers is preferably at least 300 mm. The surface of the third and fourth godet rollers 15, 16, too, may be the mirror surface, but is preferably an embossed surface or the rollers are preferably a so-called "fluted rollers" equipped with grooves in parallel with the axis.

EXAMPLE 1

When a polyethylene terephthalate resin having a limiting viscosity of 0.65 measured in orthochlorophenol at 25° C. was melt-spun from a spinneret having an orifice diameter of 0.25 mm and the number of orifices of 24 at a discharge rate of 27.8 g/min and a spinning temperature of 298° C. in the apparatus shown in FIG. 1, drawing was carried out by setting the peripheral speeds of the first and second godet rollers 7, 19 to 2,500 m/min and 5,000 m/min, respectively, and changing the conditions of the normal pressure steam treating device 8 as in Nos. 1 and 2 of Table 1. Next, heat-treatment was carried out by the pressurized steam treating device 9 between the second and third godet rollers 10, 15 having the same peripheral speed under the condition shown in Table 1, and the fiber was taken up by the take-up machine 13 through the fourth godet roller set to the same peripheral speed as that of the third godet roller 15. Here, the first and second godet rollers were non-heating rollers each having a mirror surface, and their effective contact length was 340 mm. The normal pressure steam treating device had a treating length of 100 mm and a yarn passage port of 0.6 mm, and the pressurized steam treating device 9 had a treating length of 600 mm and a multi-stage yarn passage port to which sufficient seal was applied. An oiling guide was used as oiling means, and a water emulsion oiling agent having a concentration of 10% was applied in a proportion of 1.5% (on the basis of wt % of the fiber). Pressurized air to be supplied to the interlacing nozzles 6, 14 was 1.5 and 3.0 $kg/cm^2$, respectively.

Yarn quality of the resulting fiber after measurement was tabulated in Table 1.

Among the measurement results tabulated in Table 1, the dyeing specks and dyeing flecks were measured by the following evaluation methods, respectively.

Dyeing specks:

The resulting fiber was knitted to a cylindrical knit fabric, the cylindrical knit fabric was dyed under the ordinary dyeing condition, and dyeing quality was evaluated with the naked eye under the following standards:

○ . . . no dyeing speck was observed

Δ . . . some linear specks were observed

× . . . a large number of linear specks were observed

Dyeing flecks:

The number of densly dyed portions (undrawn yarn portions) of the single yarns per 80 $cm^2$ area was counted using the dyed cylindrical knit fabric used for the judgement of the dyeing specks, and evaluation was made in accordance with the following standards:

○ . . . number of dyeing flecks 0/80 $cm^2$

Δ . . . number of dyeing flecks 1–2/80 $cm^2$

× . . . number of dyeing flecks more than 3/80 $cm^2$

Among the fabrics evaluated as ○, woven fabrics obtained by picking two wefts per 1,000 $cm^2$ were dyed, and those in which dyeing flecks were not observed were evaluated as ⊙.

TABLE 1

| | No. | 1 | 2 |
|---|---|---|---|
| condition | normal pressure steam temperature (°C.) | 118 | 96 |
| | pressurized steam temperature (°C.) | 115 | 115 |
| | pressurized steam pressure ($kg/cm^2 \cdot G$) | 1.0 | 1.0 |
| | first godet roller outlet tension (g) | 42 | 43 |
| | second godet roller outlet tension (g) | 8 | 7 |
| | first godet roller outlet entanglement (pcs/m) | 4 | 4 |
| yarn quality | strength (g/d) | 4.2 | 4.3 |
| | elongation (%) | 34 | 33 |
| | boiling shrinkage (%) | 16.6 | 15.5 |
| | birefringence | 0.133 | 0.140 |
| | dyeing flecks | ○ | ○ |
| | dyeing specks | ○ | ○ |

It can be understood from the results tabulated in Table 1 that uniform stretched yarns substantially devoid of dyeing specks could be obtained under the condition of the present invention.

EXAMPLE 2

The condition of the pressurized steam treating device 8 was changed from the condition shown in Example 1 to the condition Nos. 3. 4 and 5 of Table 2. Further, the yarns were entangled by the interlacing nozzle 6, entanglement was imparted to the yarns taken up by the interlacing nozzle 11 as shown in Table 2, the interlacing nozzle 14 was removed and an oiling roller was used as the oiling device 4. The rest of the conditions were the same as in Example 1. Under such conditions, the fiber of polyethylene terephthalate was obtained in the same way as in Example 1. Pressurized air supplied to the interlacing nozzles 6, 11 was 1.0 and 3.0 $kg/cm^2.G$, respectively. The yarn quality obtained in this way was tabulated in Table 2.

TABLE 2

| | No. | 3 | 4 | 5 |
|---|---|---|---|---|
| condition | normal pressure steam temperature (°C.) | 118 | 118 | 118 |
| | pressurized steam temperature (°C.) | 115 | 121 | 130 |
| | pressurized steam pressure ($kg/cm^2 \cdot G$) | 1.0 | 1.5 | 2.5 |
| | 1st godet roller outlet tension (g) | 39 | 37 | 34 |
| | 2nd godet roller outlet tension (g) | 8.5 | 7 | 6 |
| | entanglement at 1st godet roller (pc/m) | 1.5 | 1.5 | 1.5 |
| | entanglement of yarn taken up (pc/m) | 17 | 13 | 16 |
| yarn quality | strength (g/d) | 4.3 | 4.3 | 4.5 |
| | elongation (%) | 34.0 | 35.3 | 33.4 |
| | boiling shrinkage (%) | 14.5 | 10.5 | 9.8 |
| | birefringence | 0.144 | 0.141 | 0.141 |
| | dyeing flecks | ⊙ | ⊙ | ⊙ |
| | dyeing specks | ⊙ | ⊙ | ⊙ |

It could be understood from Table 2 that drawn yarns not having dyeing specks could be obtained, and the boiling water shrinkage ratio dropped due to the improvement in the pressurized steam heat-treatment.

EXAMPLE 3

Fibers were obtained in the same way as in Example 2 except that interlacing nozzle 11 in the method of Example 2 was removed and the interlacing nozzle 14 was instead used, and the condition of the pressurized steam treating device 9 was changed to Nos. 6, 7 and 8 shown in Table 3. The properties of the resulting fiber were tabuled in Table 3.

TABLE 3

| | No. | 6 | 7 | 8 |
|---|---|---|---|---|
| condition | normal pressure steam temperature (°C.) | 118 | 118 | 118 |
| | pressurized steam temperature (°C.) | 115 | 125 | 130 |
| | pressurized steam pressure ($kg/cm^2 \cdot G$) | 1.0 | 2.0 | 2.5 |
| | 1st godet roller outlet tension (g) | 39 | 37 | 37 |
| | 2nd godet roller outlet tension (g) | 8 | 7 | 7 |
| | 1st godet roller outlet entanglement (pc/m) | 1.5 | 1.5 | 1.5 |
| | taken up yarn entanglement (pc/m) | 8 | 8 | 8 |
| yarn quality | strength (g/d) | 4.2 | 4.4 | 4.3 |
| | elongation (%) | 39.3 | 39.7 | 37.0 |
| | boiling shrinkage (%) | 28.9 | 19.6 | 16.4 |
| | birefringence | 0.143 | 0.140 | 0.137 |
| | dyeing flecks | ○ | ○ | ○ |
| | dyeing specks | ○ | ○ | ○ |

It could be understood from Table 3 that uniform drawn yarns substantially devoid of dyeing specks could be obtained and the boiling water shrinkage ratio dropped with the temperature rise of the pressurized steam.

EXAMPLE 4

The polyester fiber was obtained in the same way as in Example 1, No. 1 except that only the interlacing nozzle 14 was used in FIG. 1. Yarn quality of the resulting fiber was tabulated in Table 4.

TABLE 4

| | No. | 9 | 10 | 11 |
|---|---|---|---|---|
| condition | pressure of interlacing pressurized air (kg/cm$^2$ · G) | 0 | 1 | 4 |
| | 2nd godet roller outlet entanglement (pc/m) | 0 | 1.5 | 7.6 |
| yarn quality | strength (g/d) | 4.3 | 4.3 | 4.1 |
| | elongation (%) | 34 | 35 | 28 |
| | boiling shrinkage (%) | 13 | 12 | 12 |
| | birefringence | 0.134 | 0.137 | 0.130 |
| | dyeing flecks | ⊙ | ⊙ | ○ |
| | dyeing specks | ○ | ○ | ○ |

It could be understood from the results shown in Table 4 that uniform drawn yarns substantially devoid of dyeing specks could be obtained under the conditions of the present invention. As to dyeing flecks, the number of entanglement at the second godet roller outlet was preferably set to up to 5 pcs/m. As to No. 9. further, when the fiber taken up was beaten, the fiber came to possess crimps and the shrinkage ratio between the single yarns exhibited variance.

Comparative Example 1

When spinning was conducted in the same way as in Example 1 using the apparatus similar to the one shown in FIG. 4 except that the normal pressure steam treating device 8 and the interlacing nozzle 14 were removed from the production apparatus shown in FIG. 4, the fiber was obtained by changing the peripheral speed of the first godet roller 7 to Nos. 12, 13 and 14 in Table 4. Fiber quality of the resulting fiber was tabulated in Table 5.

TABLE 5

| | No. | 12 | 13 | 14 |
|---|---|---|---|---|
| condition | first godet roller speed (m/min) | 2500 | 3000 | 4000 |
| | second godet roller speed (m/min) | 5000 | 5000 | 5000 |
| | pressurized steam temperature (°C.) | 115 | 115 | 115 |
| | pressure of pressurized stem (kg/cm$^2$ · G) | 1.0 | 1.0 | 1.0 |
| | first godet roller outlet tension (g) | 18 | 14 | 15 |
| | first godet roller outlet entanglement (pc/m) | 8.5 | 8 | 5 |
| yarn quality | strength (g/d) | 4.1 | 3.9 | 4.2 |
| | elongation (%) | 33.5 | 36.7 | 47.9 |
| | boiling shrinkage (%) | 9.8 | 9.3 | 8.6 |
| | birefringence | 0.147 | 0.132 | 0.111 |
| | dyeing flecks | x | x | Δ |
| | dyeing specks | x | x | Δ |

It could be understood from the results shown in Table 5 that when the undrawn yarn taken up at a peripheral speed of less than 4,000 m/min of the first godet roller was drawn and heat-treated by the pressurized steam treating device 9, dyeing specks occurred. The first godet roller output tension was also low at this time. When the fiber taken up at a peripheral speed of the first godet roller of 4,000 m/min at this time was drawn and heat-treated by the pressurized steam treating device 9, the occurrence of the dyeing flecks could be reduced, but the degree of orientation was low, and only the fiber having a high elongation could be obtained.

EXAMPLE 5

The fiber of polyethylene terephthalate was obtained in the same way as in Example 1, No. 1, except that the number of apertures of the spinneret was 12, the oiling agent was applied by a roller oiling device, and two rod-like friction members made of ceramics were disposed in parallel at the yarn passage port on the outlet side of the normal pressure steam treating device. Yarn quality of the resulting fiber was shown in Table 6.

TABLE 6

| | No. | 15 | 16 | 17 |
|---|---|---|---|---|
| condition | first godet roller speed (m/min) | 2500 | 3000 | 4000 |
| | second godet roller speed (m/min) | 5000 | 5100 | 5300 |
| | pressurized steam temperature (°C.) | 115 | 115 | 115 |
| | first godet roller outlet tension (g) | 28 | 32 | 34 |
| yarn quality | strength (g/d) | 4.3 | 4.3 | 4.5 |
| | elongation (%) | 29 | 32 | 33 |
| | boiling shrinkage (%) | 14 | 14 | 12 |
| | birefringence | 0.144 | 0.140 | 0.133 |
| | dyeing flecks | ⊙ | ⊙ | ⊙ |
| | dyeing specks | ○ | ○ | ○ |

It could be understood from the result shown in Table 6 that a uniform drawn yarn substantially devoid of dyeing specks could be obtained under the condition of the present invention.

Comparative Example 2

The results when the treating length of the oiling device, the treating length of the normal pressure steam treating device, the pressure of pressurized air of the interlacing nozzle 14 and the treating length of the pressurized steam treating device were changed in Example 5, No. 15 as tabulated in Table 7.

TABLE 7

| | No. | 18 | 19 | 20 | 21 |
|---|---|---|---|---|---|
| condition | oiling device | roller | roller | roller | roller |
| | treating length of normal pressure treating device (mm) | 100 | 600 | 100 | 100 |
| | pressure of pressurized air of interlacing device (kg/cm$^2$ · G) | 1 | 1 | 4 | 1 |
| | treating length of pressurized steam treating device (mm) | 600 | 600 | 600 | 50 |
| yarn quality | strength (g/d) | 4.0 | 4.1 | 3.7 | 4.4 |
| | elongation (%) | 29 | 27 | 24 | 32 |
| | boiling shrinkage (%) | 14 | 14 | 16 | 57 |
| | dyeing flecks | ○ | Δ | Δ | — |
| | dyeing specks | ○ | ○ | Δ | — |

In Nos. 18, 19 and 20, dyeing flecks were likely to occur because the treating length of each of the oiling device and the normal steam treating device and the pressure of the pressurized air were not sufficiently optimized. In No. 21, the treating length of the pressurized steam treating device was so short that the resulting fiber had an extremely high shrinkage ratio.

EXAMPLE 6

Example 5, No. 15 was modified by reducing the diameter of the second godet roller and setting the effective contact length to 250 mm to provide No. 22, by using the embossed surface for the second godet roller to provide No. 23, and by using a fluted roller having grooves formed on the roller surface at a groove ratio of 30% at a pitch of 2 mm in a vertical direction relative to the fiber travelling direction (effective contact length=238 mm) without changing the diameter of the second godet roller, to provide No. 24, respectively.

Though dyeing flecks did not occur in all of Nos. 22, 23 and 24, the fibers taken up exhibited crimps when they were beaten, and the shrinkage ratio exhibited variance.

Industrial Applicability

The production method and apparatus for producing the polyester fiber according to the present invention described above can be used for the spinning step of the polyester fibers. In such a production method and apparatus, the present invention can be used effectively for the applications for producing the fibers having excellent mechanical characteristics such as high strength and elongation and excellent thermal characteristics such as boiling shrinkage and dry shrinkage and particularly those fibers which are devoid of dyeing specks such as dyeing flecks, with high productivity.

We claim:

1. A method of producing a polyester fiber comprising:

cooling a plurality of polyester fibers melt-spun from a spinneret to a temperature below a glass transition point;

taking up said fibers at a take-up speed of less than 4,000 m/min by a non-heating first godet roller;

heat-drawing said fibers between said first godet roller and a non-heating second godet roller in a normal pressure steam atmosphere at a temperature above the glass transition point of said polyester fiber; and heat-treating said fibers in a pressurized steam atmosphere at a temperature not lower than 105° C.

2. A method of producing a polyester fiber according to claim 1, wherein the speed of said first godet roller is not lower than 2,000 m/min.

3. A method of producing a polyester fiber according to claim 1, wherein said fiber is taken up by said second godet roller, and said fiber is allowed to travel in said pressurized steam atmosphere under the stretch ratio of not less than 0% to not more than 10% between said second godet roller and a third godet roller.

4. A method of producing a polyester fiber according to claim 1, wherein after a plurality of said polyester fibers are cooled to a temperature below the glass transition point, an oiling agent is imparted to said fibers by a roller oiling device in a path upstream of said first godet roller.

5. A method of producing a polyester fiber according to claim 1, wherein, after a plurality of said polyester fibers are cooled to a temperature below the glass transition point, entanglement of not less than 1 pc/m to not more than 5 pcs/m is imparted by a interlacing nozzle in a path upstream of said second godet roller.

6. A method of producing a polyester fiber according to claim 1, wherein the length of said normal pressure steam atmosphere is not less than 50 mm to not more than 500 mm.

7. A method of producing a polyester fiber according to claim 1, wherein the temperature of said normal pressure atmosphere is not higher than 250° C.

8. A method of producing a polyester fiber according to claim 1, wherein yarns are subjected to friction by a friction member at a yarn passage port in said normal pressure steam atmosphere.

9. A method of producing a polyester fiber according to claim 1, wherein the length of said pressurized steam atmosphere is not less than 100 to not more than 1,000 mm and has a pressure of not less than 0.5 to not more than 5 $kg/cm^2 \cdot G$.

10. A method of producing a polyester fiber according to claim 1, wherein the surfaces of said first and second godet rollers are mirror finished.

11. A method of producing a polyester fiber according to claim 5, wherein the position of installation of said interlacing nozzle is downstream of said normal pressure steam atmosphere.

12. A method of producing a polyester fiber according to claim 10, wherein an effective contact length of each of said first and second godet rollers is at least 300 mm.

13. An apparatus for producing a polyester fiber comprising:

a melt-spinning portion for spinning a plurality of polyester fibers from a spinneret;

a chimney for cooling said fibers spun from said melt-spinning portion to a temperature below a glass transition point;

a non-heating first godet roller for taking up said fibers cooled by said cooling chimney at a take-up speed of less than 4,000 m/min;

a non-heating second godet roller for drawing said fibers, rotating at a higher peripheral speed than said first godet roller;

a first heat-treating device for heating said fibers to a temperature above the glass transition point inside a normal pressure steam atmosphere between said first and second godet rollers; and a second heat-treating device for heat-treating said fibers to a temperature not lower than 105° C. inside a pressurized steam atmosphere, disposed downstream of said first heat-treating device.

14. An apparatus for producing a polyester fiber according to claim 13, which further comprises a second heat-treating device on the downstream side of said second godet roller, and a third godet roller rotating at substantially the same peripheral speed as that of said second godet roller, said third godet roller being disposed on the downstream side of said second heat-treating device.

15. An apparatus for producing a polyester fiber according to claim 13, which further comprises an oiling device between said chimney and said first godet roller and a twisting device upstream of said second godet roller.

16. An apparatus for producing a polyester fiber according to claim 13, wherein a length of a fiber passage portion of said first heat-treating device is not less than 50 to not more than 500 mm.

17. An apparatus for producing a polyester fiber according to claim 13, wherein a yarn passage port of said first heat-treating device is a slit and its open width is not greater than 1 mm.

18. An apparatus for producing a polyester fiber according to claim 13, wherein a friction member for said fibers is disposed inside said first heat-treating device.

19. An apparatus for producing a polyester fiber according to claim 13, wherein a nozzle portion of said first heat-treating device forms a slit, and a travelling direction of yarns is arranged to be vertical with respect to a longitudinal direction of said slit.

20. An apparatus for producing a polyester fiber according to claim 13, wherein a length of said fiber passage portion of said second heat-treating device is not less than 100 to not more than 1,000 mm.

21. An apparatus for producing a polyester fiber according to claim 13, wherein the surface of each of said first and second godet rollers is mirror finished.

22. An apparatus for producing a polyester fiber according to claim 19, wherein said nozzle portion of said first heat-treating device forms a pair of slits opposing each other via the travelling fibers.

23. An apparatus for producing a polyester fiber according to claim 13, wherein said first heat-treating device comprises a yarn passage port and a friction member for said fiber, said friction member being positioned in said yarn passage port.

24. A method of producing a polyester fiber according to claim 1, wherein yarns are subjected to friction by a friction member positioned in said normal pressure steam atmosphere.

* * * * *